United States Patent [19]

Chafetz et al.

[11] 4,382,007

[45] May 3, 1983

[54] NOVEL DISPERSANT-VI IMPROVERS AND LUBRICATING OIL CONTAINING SAME

[75] Inventors: Harry Chafetz, Glenham; Richard F. Love, Fishkill; James O. Waldbillig, Wappingers Falls, all of N.Y.

[73] Assignee: Texaco Inc., White Plains, N.Y.

[21] Appl. No.: 391,089

[22] Filed: Jun. 23, 1982

Related U.S. Application Data

[63] Continuation-in-part of Ser. No. 230,241, Feb. 2, 1981, abandoned.

[51] Int. Cl.[3] ..... C10M 1/32

[52] U.S. Cl. ..... 252/51.5 A; 252/55; 525/282; 525/381

[58] Field of Search ..... 252/51.5 A, 55; 525/282, 381

[56] References Cited

U.S. PATENT DOCUMENTS

| | | | |
|---|---|---|---|
| 3,687,905 | 8/1972 | Dorer | 525/381 X |
| 3,864,268 | 2/1975 | Culbertson et al. | 525/381 X |
| 3,931,024 | 1/1976 | Hu | 252/51.5 A |
| 4,051,050 | 9/1977 | Elliott et al. | 252/51.5 A X |
| 4,068,056 | 1/1978 | Engel et al. | 252/51.5 A X |
| 4,113,636 | 9/1978 | Engel et al. | 252/51.5 A X |
| 4,134,844 | 1/1979 | De Uries et al. | 252/51.5 A X |
| 4,152,276 | 5/1979 | Jackish | 252/51.5 A |

FOREIGN PATENT DOCUMENTS

| | | | |
|---|---|---|---|
| 1028794 | 3/1978 | Canada | 252/51.5 A |

*Primary Examiner*—Andrew Metz

*Attorney, Agent, or Firm*—Carl G. Ries; Robert A. Kulason; Henry W. Archer

[57] ABSTRACT

This invention concerns dispersant-VI improvers prepared by reacting a polyamine-derived dispersant with an oxidized ethylene-propylene polymer or ethylene-propylene-diene terpolymer. The products thus formed have a dispersancy superior to that obtained by separately blending the reactants in a lubricating oil. Also disclosed are oils containing the present dispersant-VI improvers.

10 Claims, No Drawings

NOVEL DISPERSANT-VI IMPROVERS AND LUBRICATING OIL CONTAINING SAME

CROSS-REFERENCE TO CO-PENDING APPLICATION

This application is a continuation-in-part of commonly assigned application Ser. No. 230,241, filed Feb. 2, 1981 and now abandoned.

BACKGROUND OF THE INVENTION

This invention relates to the art of lubrication and more specifically to novel polymers endowed with the properties of dispersing sludge formed in lubricating oil during use and of improving the viscosity-index or temperature behavior of such oils.

STATEMENT OF PRIOR DISCLOSURES

There are many patents or processes for modifying polymeric lube oil additives and some of these relate to the grafting of monomers to polymers that are still being processed. Accordingly, this background disclosure is restricted to those which are believed most relevant.

In considering this invention, the applicants are aware of U.S. Pat. No. 3,785,980 which shows a lubricating oil additive which is the reaction product of a primary or secondary amine and a hydroperoxized atatic ethylene/propylene copolymer. This additive has a thickening power in the range of 50–150 SUS and has an infrared spectrum containing distinguishing absorbance peaks at specific frequencies.

Coassigned U.S. Pat. No. 4,123,661 is pertinent for its disclosure of dispersant viscosity index improvers consisting of the free radical catalyzed reaction product of di(lower)alkylamino-(lower)alkylamine with a hydroperoxidized ethylene/propylene copolymer or terpolymer.

U.S. Pat. No. 3,789,980 discloses an additive consisting of the reaction product of a primary or secondary amine, and a hydroperoxized ethylene/propylene copolymer. U.S. Pat. No. 3,687,849 describes lubricant additives consisting of graft polymers prepared from various polymerizable unsaturated monomers and an oxidized degraded interpolymer of ethylene and propylene. U.S. Pat. No. 3,879,304 reports a terpolymer having thereon a graft of a polymethacrylate. U.S. Pat. No. 3,076,791 discloses lubricating oil additives produced by the free radical reaction of an ethylene/propylene copolymer with an amine.

Oxidation of hydrocarbon polymers is disclosed in U.S. Pat. Nos. 2,811,514; 3,110,708, and 3,232,917. Hydroperoxidation of ethylene/propylene copolymers followed by subsequent reduction of the hydroperoxide sites to hydroxyl groups is disclosed in U.S. Pat. Nos. 3,388,067; 3,404,091 and 3,404,092. Reaction of hydrocarbon or oxygenated hydrocarbon polymers with nitrogen-containing compounds is disclosed in U.S. Pat. Nos. 3,293,326; 3,350,381 and 3,481,908.

As will be seen hereinafter none of these patents disclose, hint, or suggest applicants' novel, unique and unobvious process and composition.

SUMMARY OF THE INVENTION

The present invention, in its composition aspect, resides in a lubricating formulation comprising in major portion a lubricating oil and a lesser amount of an effective dispersing and viscosity improving additive obtained by oxidizing until the formation of a significant carbonyl IR band, in a suitable solvent, from 5 to 20 parts thereof of an ethylene/propylene copolymer or terpolymer the termonomer being thereof an unsaturated hydrocarbon and said polymer having a molecular weight of 5000 to 500,000 the oxidation optionally being carried out in the presence of a free radical initiator catalyst, by passing air through the reaction medium; and reacting the resulting polymer oxidate with a dispersant derived from polyisobutenyl monocarboxylic acids or dicarboxylic acid anhydrides reacted with polyamines, including polyethyleneamines and polypropyleneamines; derivatives of chlorinated polybutylenes and polyamine or derivatives of formaldelyde-polyamine adducts of polyisobutyl phenols.

In its product aspect, the present invention is a lube oil additive consisting of the oxidation product of an ethylene-propylene copolymer or terpolymer wherein the termonomer is an unsaturated hydrocarbon and the polymer has a molecular weight in the range of 5000 to 500,000 condensed with from 0.5 to 10 weight percent of a dispersant derived from polyisobutenyl monocarboxylic acids or dicarboxylic acid anhydrides reacted with polyamines including polyethyleneamines or polypropyleneamines; derivatives of chlorinated polybutylenes; or polyamines and derivatives of formaldehyde-polyamine adducts of polyisobutyl phenols.

The process of the invention comprises oxidizing in an inert atmosphere using air or oxygen at 140° to 160° C. with agitation a 5000 to 500,000 molecular weight ethylene/propylene copolymer or a terpolymer the termonomer thereof being an unsaturated hydrocarbon, in an inert solvent or in a mineral oil, until the formation of a substantial concentration of carbonyl bonds is observed and then reacting the thus formed polymer oxidate by heating with a dispersant derived from polyisobutenyl monocarboxylic acids or dicarboxylic anhydrides and amines; derivatives of chlorinated polybutylenes and polyamines; or derivatives of formaldehyde-polyamine adducts of polyisobutyl phenols.

DETAILED DISCLOSURE OF THE INVENTION

The ethylene-propylene polymer reactant (EP) used herein is generally atactic and contains about 45–65 mole percent of ethylene and 55 to 35 mole percent of propylene and 0 to 5 percent of an unsaturated hydrocarbon such as a diene, cycloalkene or bicycloalkene. The copolymer or terpolymer preferentially will have a molecular weight of 5,000 to 500,000.

Examples of suitable nitrogeneous dispersants derived from polyalkenyl monocarboxylic acids and dicarboxylic anhydrides reacted with amines include polyisobutenyl succinimides, and products derived from chlorinated polybutanes and amines or formaldehyde-polyamine adducts of polybutenyl phenols.

A preferred class of dispersants is disclosed in coassigned U.S. Pat. No. 4,048,080 which is incorporated by reference in the present disclosure. These dispersants have the formula:

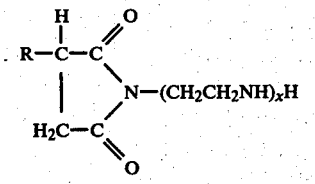

where x ranges from 1 to 6 and R is an alkenyl radical having from about 64 to about 300 aliphatic carbon atoms in the chain. The preferred dispersant is one where R is polyisobutenyl having a molecular weight of about 1250 and x is 4.

The oxidation is carried out in a suitable inert solvent such as benzene, chlorobenzene, toluene or preferably in the lubricating oil whose properties are to be improved.

Any of the well-known organic peroxides, azo and diazo free radical initiators optionally may be used in the oxidation such as dicumylperoxide, t-butyl peroxide, azobisisobutyronitrile, benzoyl peroxide and t-butyl perbenzoate. The free radical initiator is employed in a proportion ranging from about 0.1 to 2.0 weight percent based on the weight of the hydrocarbon polymer.

The oxygen source may be oxygen, air, or other oxygen-containing gas supplied as an external source of oxygen to the oxidation reaction chamber. Preferably, a 50—50 mixture of air and nitrogen is used. The gas may be introduced in the chamber at any flow rate. Usually, the gas is provided at a rate sufficient to exchange all of the oxygen in the oxidation reaction chamber every few seconds. Means are provided for maintaining the chamber at an elevated temperature in the range of about 50°-200° C., usually about 70°-180° C. Means are also provided for agitating the mixture of ethylene/propylene copolymer, initiator, and solvent in order to provide optimum mixing of the components.

When infrared measurements indicate that an adequate carbonyl absorbtion band at 5.78 microns is formed, the nitrogenous dispersant and the oxidized polymer then are reacted by heating in the same solvent which was used for the oxidation. By "adequate absorption band" is meant a ratio of infrared $CO/CH_3$ absorption bands (near 5.78 and 7.35 microns) of about 0.8 to 2.2. The oxidate/dispersant mixture is reacted at a temperature of 130° to 140° C. for about one hour followed by heating for about two hours at about 160° C. Where the solvent used is other than an oil, the oil whose properties are to be improved is added at the end of the oxidation. The inert solvent then is distilled out at atmospheric pressure and the residual oil solution is heated to around 160° C. for about 3 hours.

In the present reaction, the actual ratio of nitrogenous dispersant to polymer oxidate is not critical but molar ratios ranging from 0.5:1 to 3:1 of dispersant to polymer oxidate group are preferred.

The invention is further illustrated in nonlimiting fashion by the following examples:

EXAMPLE I

A solution of EP copolymer (10% by weight) in benzene containing azobisisobutyronitrile (0.4% by weight) was heated to 70°-75° C. and with rapid stirring a stream of air (167 ml./min. per 1000 gm. solution) was passed through the mixture for 18 to 24 hours. At the end of that period, a solvent neutral oil having a specific gravity of 0.85, and a viscosity in SUS units at 100° F. to 100 in the amount of about 3.3 g. per gram of polymer was added. The benzene was stripped off at atmospheric pressure and the residual oil solution heated to 160° C. for 3 hours. The degree of polymer oxidation was thereupon measured by infrared spectroscopy.

The dispersant used as the reactant was the alkenylsuccinimide derived from tetraethylene pentamine and polyisobutenyl succinic anhydride having an average molecular weight of about 1400.

The dispersant was added in amounts sufficient to react with the polymer oxidate and the resulting blend was heated under a nitrogen atmosphere to 130° C. for 2 hours, then 160° C. for one hour. The final product may be filtered as necessary. Dispersancy tests on the products are shown in Tables I and II.

EXAMPLE II

A solution of 30 grams ethylene-propylene copolymer (EP) in 170 grams of a solvent neutral oil having a sp.gr of 0.85, a viscosity 100% SUS of 123-133 was air oxidized for varied time periods at temperatures of 140° to 160° C. to form various products listed in Table III. After the formation of an adequate carbonyl band due to oxidation, as measured by the ratio of infrared absorption bands near 5.78 and 7.35 microns, the oxidation was ceased and the oxidates reacted with varying amounts of the above dispersant (1.2% N) for 2 hours at 130° C. followed by one hour at 160° C. to yield the products described in Table IV. The products of Table IV were then tested for dispersancy in typical motor oil formulations using the Bench VC (BVCT) Test.

EXAMPLE III

A 600 gram quantity of an ethylene-propyleneethylidenenorbornene terpolymer, having a molecular weight of 76,000 was dissolved in 1998 grams of a Pale Oil. (sp.gr. 0.86, API gravity 32, vis SUS at 100° F. of 145) and oxidized at 180° C. with a 1/1 mixture of air and nitrogen for 3.5 hours at 1000 ml gas/minute. The mixture was then held at 160° C. under nitrogen for one hour; cooled to 130° C. and subsequently reacted with 861 grams (1.2% N) of the above dispersant for two hours at 130° C. and one hour at 160° C. The product was vacuum filtered through paper and contained (Calculated): 17.3% polymer and 0.299% nitrogenous dispersant.

The products of the invention were evaluated for effectiveness by various tests. Of these, the Bench VC Test (BVCT) is conducted by heating the test oil mixed with a synthetic hydrocarbon blowby and a diluent oil at a fixed temperature for a fixed time period. After heating, the turbidity of the resultant mixture is measured. A low percentage turbidity (0-10) is indicative of good dispersancy while high results (200-100) are indicative of increasingly poor dispersancy of the oil blends tested.

The Sequence VC Test (Seq. VC) is detailed in the ASTM Special Technical Publication under heating 310-F. The subject test is used to evaluate crankcase motor oils with respect to sludge and varnish deposits as well as their ability to keep the positive crankcase ventilation (PVC) valve clean and functioning properly. Ratings of 0 to 10 are given, a 10 representing absolutely clean and a 0 rating representing heavy sludge and varnish deposits.

The Test results appear in Tables I to IV following.

Table I illustrates an evaluation of representative samples of such reaction products of oxidized EP copolymers for Example I, made by oxidation in benzene, and dispersant using the Bench VC Test. This laboratory test correlates well with motor oil performance in the Seq. VC engine test.

In Table I, the first two products (A, B) are derived from a high molecular weight EP copolymer (mol. wt. of 80–100,000 containing ca. 35% propylene). As shown in the Table, the low BVCT values for blended oils containing the polymer-dispersants were excellent, illustrating the remarkable effectiveness of these materials compared to the standard dispersant when measured at equivalent dispersant nitrogen levels. Examples C and D show similar products derived from oxidized EP polymers of much lower molecular weight (ca. 40,000, 44% mole propylene). A blend of standard dispersant, not reacted with polymer, is included at the bottom of the table for comparison. About three times more of the standard dispersant was required for the same BVCT rating as with products A-D.

That the improved dispersancy which arises by reacting the oxidized polymer with the succinimide is the result of a chemical combination there between and not simply a blending effect, is proven by the data in Table II. Here, the dispersant and oxidized polymer either were mixed at 70° C., heated at 130° C. or at 160° C. As can be seen, the best dispersancy (lower numbers) was given by product H formed at the highest temperature, a condition at which more complete chemical condensation of the amine function of the succinimide and the oxidized portions of the polymer will occur. The worst performance was that the product E which contained no dispersant.

Table III shows the results of Seq. VC engine tests on formulations containing oxidized EP polymer dispersant reaction products from Example I (Product I and from the method of Example III, Product J). In the first test, using Product I as the sole dispersant-VI improver, in a 10W-40 multigrade type formulation, a passing result meeting SE specification was obtained. In a second engine test, using a lesser amount of dispersant derived from a more highly oxidized polymer (Product J) in a single grade (30W) formulation, the sludge and overall varnish ratings were passing but the piston skirt varnish was marginally below that required for an SE motor oil. The result, however, did indicate the effectiveness of this type of dispersant.

Table IV illustrates laboratory dispersancy evaluation of blends (1) of reaction products of oxidized EP copolymer, made by oxidation in a lube oil base stock, and dispersant from Example II.

TABLE I

| Blend[1] | % Polymer adduct or Dispersant | % Dispersant[2] Nitrogen | BVCT | Kinematic Vis. 100, | 210° F. |
|---|---|---|---|---|---|
| Product A | 2.32 | 0.018 | 2.0 | 100.8 | 12.43 |
| " | 1.15 | 0.009 | 3.0 | 55.5 | 8.08 |
| " | 0.46 | 0.0036 | 20.0 | 36.4 | 5.13 |
| Product B | 3.95 | 0.084 | 2.0 | 103.2 | 12.58 |
| " | 2.63 | 0.056 | 2.5 | 66.5 | 9.24 |
| " | 1.31 | 0.028 | 4.5 | 42.4 | 6.59 |
| Product C | 2.01 | 0.008 | 2.5 | 67.3 | 10.03 |
| " | 1.00 | 0.004 | 5.0 | 44.6 | 7.02 |
| " | 0.04 | 0.001 | 69.0 | 34.4 | 5.61 |
| Product D | 2.64 | 0.021 | 4.0 | 85.2 | 12.2 |
| " | 1.76 | 0.314 | 3.0 | 80.8 | 9.12 |
| " | 0.81 | 0.007 | 5.0 | 42.0 | 6.72 |
| Blends of a standard succinimide (3) are included below for comparison: | | | | | |
| Blends of dispersant[3] | (7.6%) | 0.10 | 2.0 | — | |
| | (5.4%) | 0.07 | 4.0–8.0 | — | |
| | (3.1%) | 0.04 | 30.0 | — | |
| | (0.76%) | 0.01 | 60.70 | — | |

[1]The blends also contain 1.5%, overbased calcium sulfonate detergent, 1.35% zinc dithiophosphate, 0.5% methacrylate pour depressant, 0.25% antioxidant and 150 ppm of antifoaming agent.

[2]Percent nitrogen in the formulated oil which is attributed to the polymer-succinimide adduct or to the standard dispersant[3].

[3]High molecular weight succinimide dispersant consisting of a polyisobutenylsuccinimide of tetraethylene pentamine derived from a polyisobutenylsuccinic anhydride having an average molecular weight of about 1400 and a sap. no. of 60.

TABLE II

Effect of Reaction Temperatures Upon the Dispersancy of the Condensation Products of Oxidized EP Polymer and Dispersant Succinimide.

| Blend[1] | % Polymer Adduct | % Dispersant Nitrogen | BVCT | Remarks |
|---|---|---|---|---|
| Product E | 1.5 | zero | 60 | No dispersant |
| | 0.75 | " | 70 | used |
| Product F | 1.6 | 0.035 | 10 | Dispersant and EP |
| | 0.8 | 0.017 | 29 | oxidate heated at 70° C. |
| Product G | 1.6 | 0.035 | 40 | Dispersant and EP |
| | 0.8 | 0.017 | 13.0 | oxidate heated at 130° C. |
| Product H | 1.6 | 0.035 | 3.5 | Dispersant and EP |
| | 0.8 | 0.017 | 7.0 | oxidate heated at 160° C. |

[1]Blends also contain 1.5% overbased calcium sulfonate detergent, 1.35% zinc dialkyldithiophosphate, 0.5% methacrylate pour depressant, 0.25% antioxidant, and 150 ppm of antifoam agent.

TABLE III

| | Sequence VC Engine Test Data | | |
|---|---|---|---|
| | Product I[1] | Product J[2] | SE Spec (Min) |
| Sludge | 9.68 | 9.71 | 8.5 |
| Varnish | 8.21 | 8.04 | 8.0 |
| Piston Skirt Varnish | 8.04 | 7.76 | 7.9 |
| (BVCT Test) | 2.0,3.0 | 2.05,3.0 | usually 4 |
| (Percent Dispersant N) in Blended Oil | 0.018 | 0.042 | |

[1]The engine test formulation contained 11.8% of Product I, prepared by the method of Example I (3.2% EP-Dispersant, 8.6% diluent oil); 1.53% overbased calcium sulfonate 1.36% zinc dialkyldithiophosphate, 0.1% methacrylate pour dispersant, 0.25% antioxidant and 150 ppm antifoaming agent. The kinematic viscosities are 100° F. and 15.12 cs at 21.° F.

[2]The engine test formulation contained 8% of Product J prepared by the method of Example III (2.1% EP-Dispersant, 5.9% diluent oil); 1.53% overbased calcium sulfonate, 1.36% zinc dialkyldithiophosphate, 0.1% methacrylate pour depressant, 0.25% antioxidant and 150 ppm antifoam agent.

Table IV below shows the results of an evaluation of dispersant VI improvers from Example II by the Bench VC Test. Product K was made by oxidation at 140° C. for 8 hours (infrared $CO/CH_3$ ratio=1.08[a]) and reaction with 22 g of the same alkenylsuccinimide dispersant. Calc'd for product: 13.7% polymer content, 0.115%. N. Product L was made by oxidation at 140° C. for 14 hours (infrared $CO/CH_3$ ratio=0.9) and reaction with 34 g of the same dispersant. Calc'd for product: 12.7% polymer content and 0.18% N. Product M was made by oxidation at 150° C. for 2 hours (infrared $CO/CH_3$ ratio=2.08) and reaction with 60 g of the dispersant. Calc'd for product: 11.51% polymer content and 0.279% N.

TABLE IV

| | Product in Blend[1] (% Wt.) | Polymer Content (% Wt.) | % N | BVCT (2,17,50) |
|---|---|---|---|---|
| Product K | 13 | 1.78 | 0.015 | 3.5 |
| " | 9 | 1.22 | 0.01 | 3.5 |
| " | 4 | 0.55 | 0.0046 | 8.5 |
| " | 1 | 0.136 | 0.0012 | 26.0 |
| Product L | 13.5 | 1.72 | 0.024 | 3.0 |
| " | 9 | 1.14 | 0.016 | 3.5 |
| " | 4.5 | 0.57 | 0.008 | 5.5 |
| " | 1 | 0.13 | 0.002 | 23.5 |
| Product M | 15 | 1.73 | 0.042 | 3.0 |
| " | 10 | 1.15 | 0.028 | 4.0 |
| " | 5 | 0.58 | 0.014 | 12.0 |
| " | 1 | 0.11 | 0.003 | 38.5 |

[1]The oil blends each contained 1.5% overbased calcium sulfonate, 1.35% zinc dialkyldithiophosphate, 0.5% methacrylate pour depressant, 0.25% antioxidant and 150 ppm of antifoam agent.

[(a)]$CO/CH_3$ ratio measures relative intensity of the carbonyl band near 5.78 microns and $CH_3$ deformation bands near 7.25 microns.

Table V below shows the results of an evaluation of the dispersant VI improver from Example III with blends of the above in a premium type motor oil formulation containing no other VI improvers. The base oil stock for blending was a solvent neutral oil which had an API gravity of 31.5–33.5; a viscosity of SUS 123–122 and a pour point of 0° F.

TABLE V

| Blend | Percent Additive | Percent N Dispersant | BVCT | ASTM Color | Kinematic Visc. 100, | 210° F. |
|---|---|---|---|---|---|---|
| Va | 12 | 0.036 | 3.5 | 4.5 | 93.7, | 12.71 |
| Vb | 6 | 0.018 | 5.0 | 3.5 | 52.8, | 8.03 |
| Vc | 3 | 0.009 | 10.0 | 2.5 | 39.7, | 6.31 |
| Vd | 6 | 0.042[(a)] | 4.0 | 3.5 | 57.6, | 8.54 |

[(a)]Contains supplemental 0.024% N from blended, not reacted, dispersant consisting of an alkenylsuccinimide derived from tetraethylene pentamine and alkenylsuccinic anhydride having a Sap. No. of 50.

The above examples and data are intended to be illustrative only. It will be apparent to those skilled in the art that there are many embodiments of the compositions described above which are within the scope and range of this invention.

Thus while the invention has been illustrated mainly by reference to the performance of the reaction product of EP copolymer oxidates with a dispersant consisting of an alkenylsuccinimide derived from tetraethylene pentamine and polyisobutenyl succinic anhydride, equivalent results are obtained when the dispersant consists of products derived from chlorinated polybutanes and amines or formaldehyde polyamine adducts of polybutenyl phenols.

What we claim is:

1. A lubricating composition comprising a major portion of a lubricating oil and an effective dispersing and viscosity improving amount of an additive obtained by oxidizing in an inert solvent or in mineral oil, optionally in the presence of a free radical initiator, an ethylene/propylene copolymer or terpolymer having a molecular weight of about 5,000 to about 500,000, the termonomer thereof being an unsaturated hydrocarbon, until the formation of adequate carbonyl groups due to oxidation and condensing the oxidized portion of the resulting polymer oxidate with the amine function of a nitrogenous dispersant derived from the reaction of a dicarboxylic anhydride with a polyamine.

2. The composition of claim 1 containing from 0.5 to 10 weight percent of said additive.

3. The composition of claim 1 wherein said dispersant is a polyalkenyl succinimide represented by the formula:

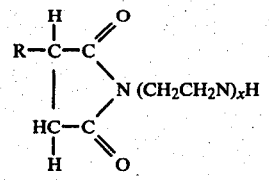

wherein R is an alkenyl radical having from about 64 to about 300 aliphatic carbon atoms in the chain and x is 1 to 6.

4. The composition of claim 1 wherein said copolymer or terpolymer contains about 45 to 65 mole percent of ethylene; 55 to 35 mole percent of propylene and about 0 to 5 percent of an unsaturated hydrocarbon.

5. A composition of matter useful as a lubricating oil additive consisting of the reaction product of an oxidate of an ethylene-propylene copolymer or terpolymer with a dispersant derived from a dicarboxylic anhydride reacted with a polyamine, said copolymer or terpolymer having a molecular weight in the range of 5,000 to 500,000 and being selected from ethylene-propylene copolymers or ethylene-propylene terpolymers wherein the termonomer is an unsaturated hydrocarbon.

6. A process comprising: oxidizing in an inert solvent or mineral oil at 140° to 160° C., an ethylene/propylene copolymer or a terpolymer, the termonomer thereof being an unsaturated hydrocarbon and the polymer or terpolymer having a molecular weight of 5,000 to 500,000;

continuing oxidation until the formation of adequate carbonyl groups;

and then condensing the resulting polymer oxidate with the amine function of a nitrogenous dispersant derived from a dicarboxylic anhydride and a polyamine.

7. The process of claim 6, wherein said oxidate and said dispersant are heated to about 130° C. to 140° C. for about one hour and then at about 160° C. for about two hours.

8. The process of claim 6, conducted in an inert solvent and further including the steps of distilling said solvent, adding an oil whose properties are to be improved and heating such oil and said additive.

9. The process of claim 6, wherein there is used a molar ratio of nitrogenous dispersant to polymer oxidate ranging from 0.5:1 to 3:1.

10. The process of claim 6, wherein said oxidizing is conducted in the presence of 0.1 to 2.0 weight percent of a free radical initiator based on said copolymer or terpolymer.

* * * * *